US005385112A

United States Patent [19]

Dorris

[11] Patent Number: 5,385,112

[45] Date of Patent: Jan. 31, 1995

[54] REAR ACCESS STEP CONFIGURATION FOR PONTOON BOATS

[75] Inventor: Jimmie D. Dorris, Lebanon, Mo.

[73] Assignee: Richland Diversified Industries, Inc., Richland, Mo.

[21] Appl. No.: 169,435

[22] Filed: Dec. 17, 1993

[51] Int. Cl.[6] ..... B63B 17/00

[52] U.S. Cl. ..... 114/362; 114/61

[58] Field of Search ..... 114/362, 363, 56, 61; 182/91, 86, 85, 97, 90, 92; D12/317, 304

[56] References Cited

U.S. PATENT DOCUMENTS

| | | | |
|---|---|---|---|
| 2,975,747 | 3/1961 | Opie | 114/61 |
| 3,709,178 | 1/1973 | Piker et al. | 114/290 |
| 3,794,140 | 2/1974 | Sell | 114/362 |
| 4,293,967 | 10/1981 | Ord | 114/362 |
| 4,726,317 | 2/1988 | Ritten et al. | 114/362 |
| 5,184,561 | 2/1993 | Nickell, Jr. | 114/61 |

FOREIGN PATENT DOCUMENTS

| | | | |
|---|---|---|---|
| 1077096 | 3/1960 | Germany | 114/362 |
| 466836 | 11/1951 | Italy | 114/61 |
| 0163087 | 7/1986 | Japan | 114/362 |

*Primary Examiner*—Edwin L. Swinehart

*Attorney, Agent, or Firm*—Robbins & Robbins

[57] ABSTRACT

A rear access step configuration for pontoon boats is provided. The hollow cylindrical hulls of the boat are modified to form a slightly forward slanting truncated end at the rear of the boat. Steps are formed at the rear end and internally of one of the cylinder hulls to allow a person in the water to climb directly onto the boat at the rear end thereof. A pivotable step is positioned at the rear bottom edge of the step configuration to assist a person in the water to mount the hull end. It can be retracted up and out of position when not in use to avoid drag and spray when the boat is on motion. Hand rails are also provided along the step configuration with a slight forward slant to aid a person in climbing on the boat.

17 Claims, 4 Drawing Sheets

REAR ACCESS STEP CONFIGURATION FOR PONTOON BOATS

BACKGROUND OF THE INVENTION

Pontoon boats offer a popular source of recreation for those who enjoy being on the water. It enables mobility for activities ranging from a peaceful excursion to the excitement of water skiing, and also provides a stationary platform for those who merely wish to relax on the water and take an occasional dip.

The problem exists, as in all boats, in climbing back on the boat from the water. Typically, removable vertically extending ladders are supported on the side or over the rails. These can be difficult to climb and require some physical exertion. On many pontoon boats, however, the side rails are not sturdy enough to withstand the jarring abuse from supporting the weight of a person climbing aboard. Also, the sides of the boat may become marred from use of the side ladder. Many boat owners take great pride in the appearance of their vessels and treat their exterior with as much care as they would an automobile.

Removable side ladders can be a nuisance with the constant removal and mounting. A person diving in the water from the boat is dependent upon a person still in the boat for mounting of the ladder if he forgets to do so beforehand. This is a dangerous safety hazard in the event one inadvertently falls overboard. Further, removable ladders may become lost or misplaced.

Therefore, there is a need for means for climbing aboard a pontoon boat or the like that addresses and solves the shortcomings of removable boat ladders.

SUMMARY OF THE INVENTION

By means of the instant invention there is provided a structure for allowing a person to mount a pontoon boat from the water without the use of a supplementary over-the-side ladder. The invention provides for modifying the hollow cylindrical hulls that support the pontoon boat. Typical pontoon boats utilize cylindrical hulls that taper down to a conical tip at the stern. The stern ends of the cylinder hulls of the pontoon boat of the instant invention, however, are truncated in such a way that the end surfaces have a slight forward slant and lie in a plane 5°–15° forward from the vertical plane to form a trapezoidal shape. This shape serves two functions: 1) it provides extra lift to the boat stern in the water, and 2) enables a step configuration to be formed in the end. The step configuration is recessed in the end of the hull and is formed by cutting and welding, or by molding the entire hull.

An auxiliary step member is provided and positioned at the bottom edge of the truncated cylinder to assist a person in the water in mounting the step configuration. This step member is pivotable so that it may be retracted out of the water when the boat is in motion to prevent drag. Hand rails are also provided along the hull end and back walls of the boat for a person to grasp while climbing the steps.

It is therefore an object of the invention to provide a rear access step configuration to enable a person in the water to easily climb onto a pontoon boat. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
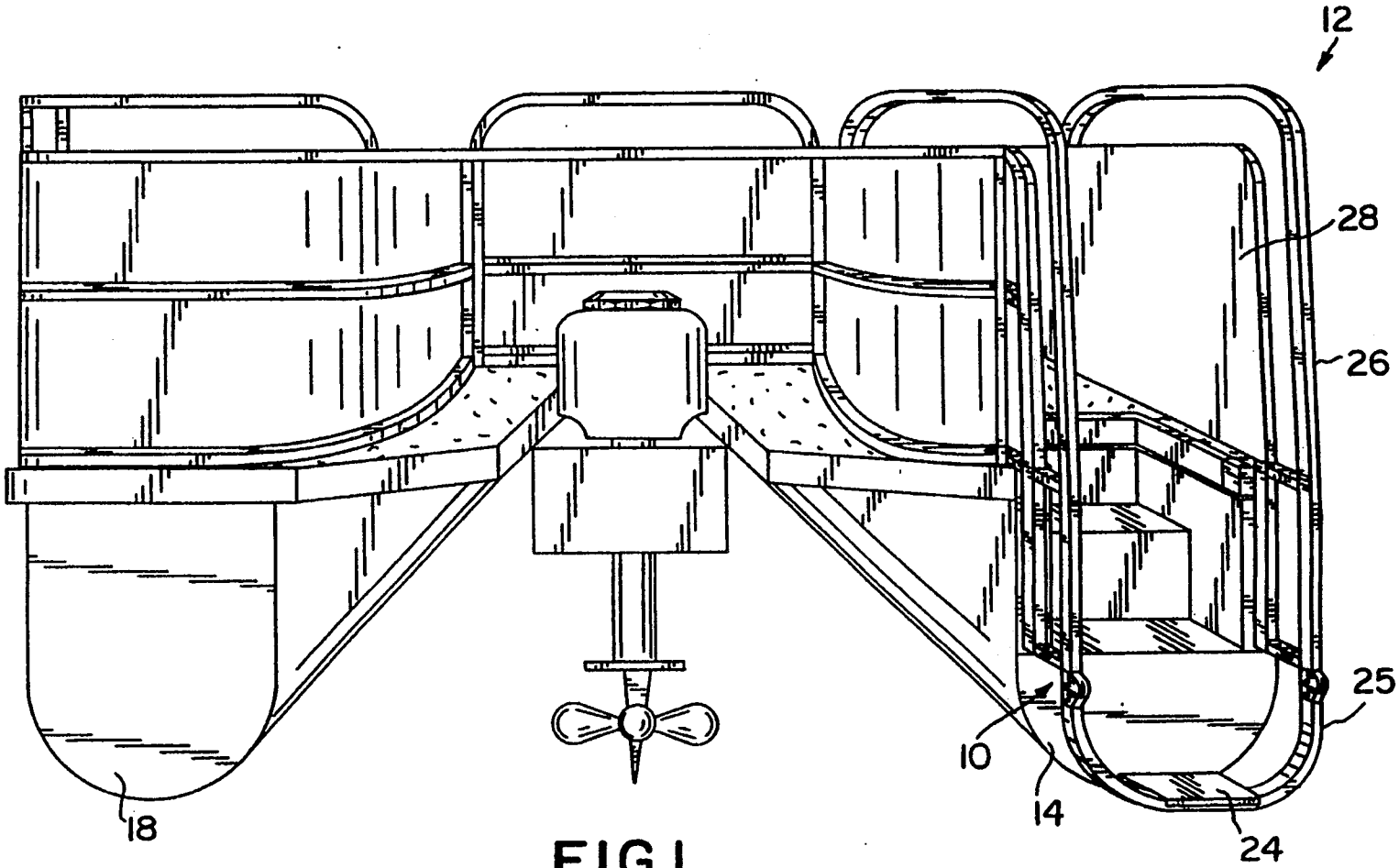
FIG. 1 is a view in side elevation from the rear of a pontoon boat having the modified pontoon hulls described herein.
Figure 3:
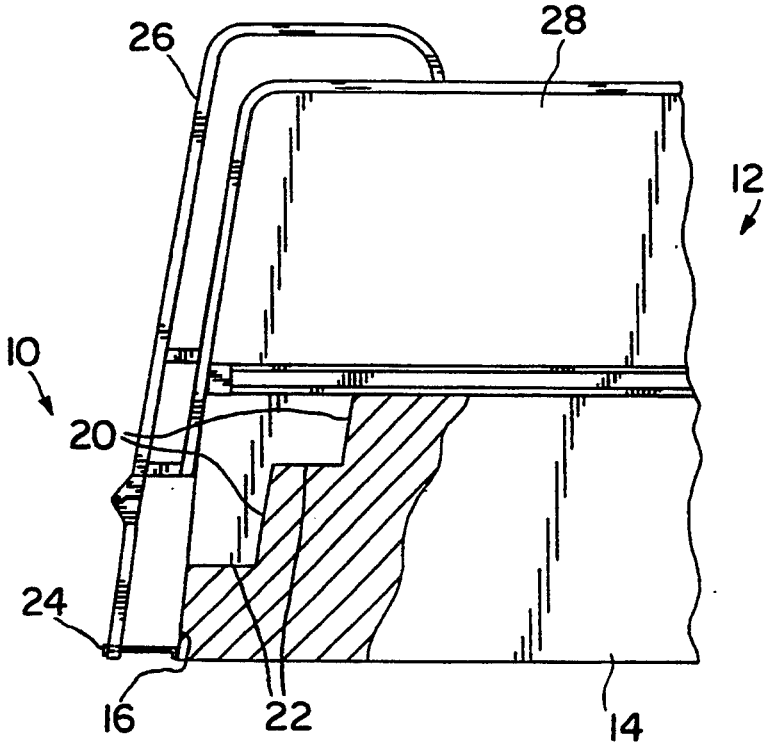
FIG. 3 is a view of the rear access step configuration in side elevation, shown partially in cross section, taken from the side of the boat.
Figure 4:
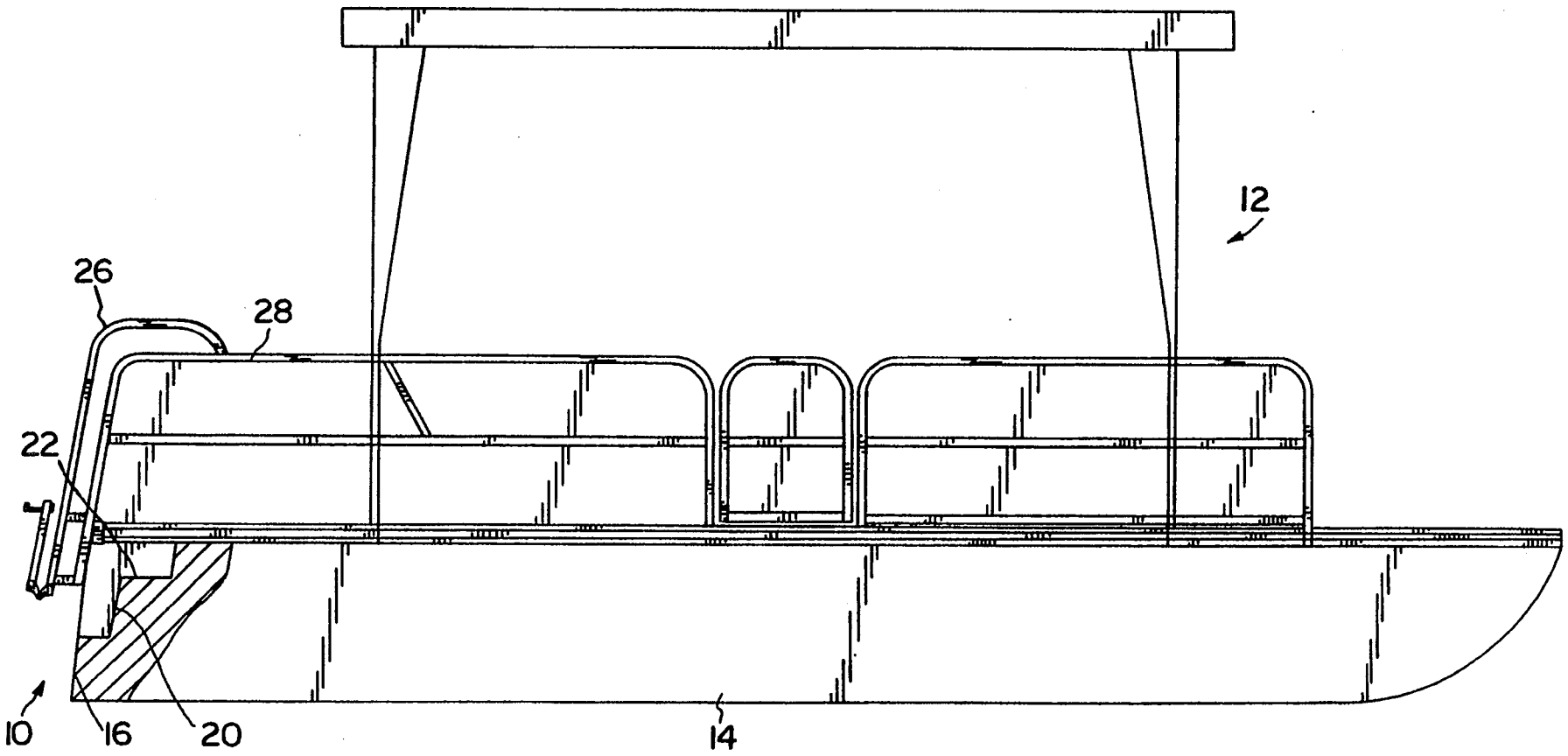
FIG. 4 is also a view of the rear access step configuration in side elevation, shown partially in cross section, taken from the side of the boat.

The rear access step configuration of the instant invention, generally indicated by the reference numeral 10, is intended for use on pontoon boats 12 or other watercraft employing cylindrical hulls 14, as shown in FIG. 1. The pontoon hulls may be rounded, U-shaped, or any other suitable configuration. They are typically hollow, sealed tubular containers and are filled with pre-cut polystyrene for buoyancy. Normally, they are torpedo-shaped and are conical at their stern, or rear, end. A deck having side walls is simply placed on top of the hulls to create the pontoon boat. The hulls 14 of this invention are modified in shape and have a truncated end 16. Hull 14 forms a generally trapezoidal shape as seen in FIGS. 3 and 4. This imparts a distinct advantage over traditional conical shaped hulls in that it provides extra buoyancy and lift at the stern of the boat which is weighted down by the outboard motor. By causing the stern, together with the fixed motor, to be carried slightly higher in the water, the drag effected by the motor is lessened. This enables the craft to move more efficiently.

Figure 2:
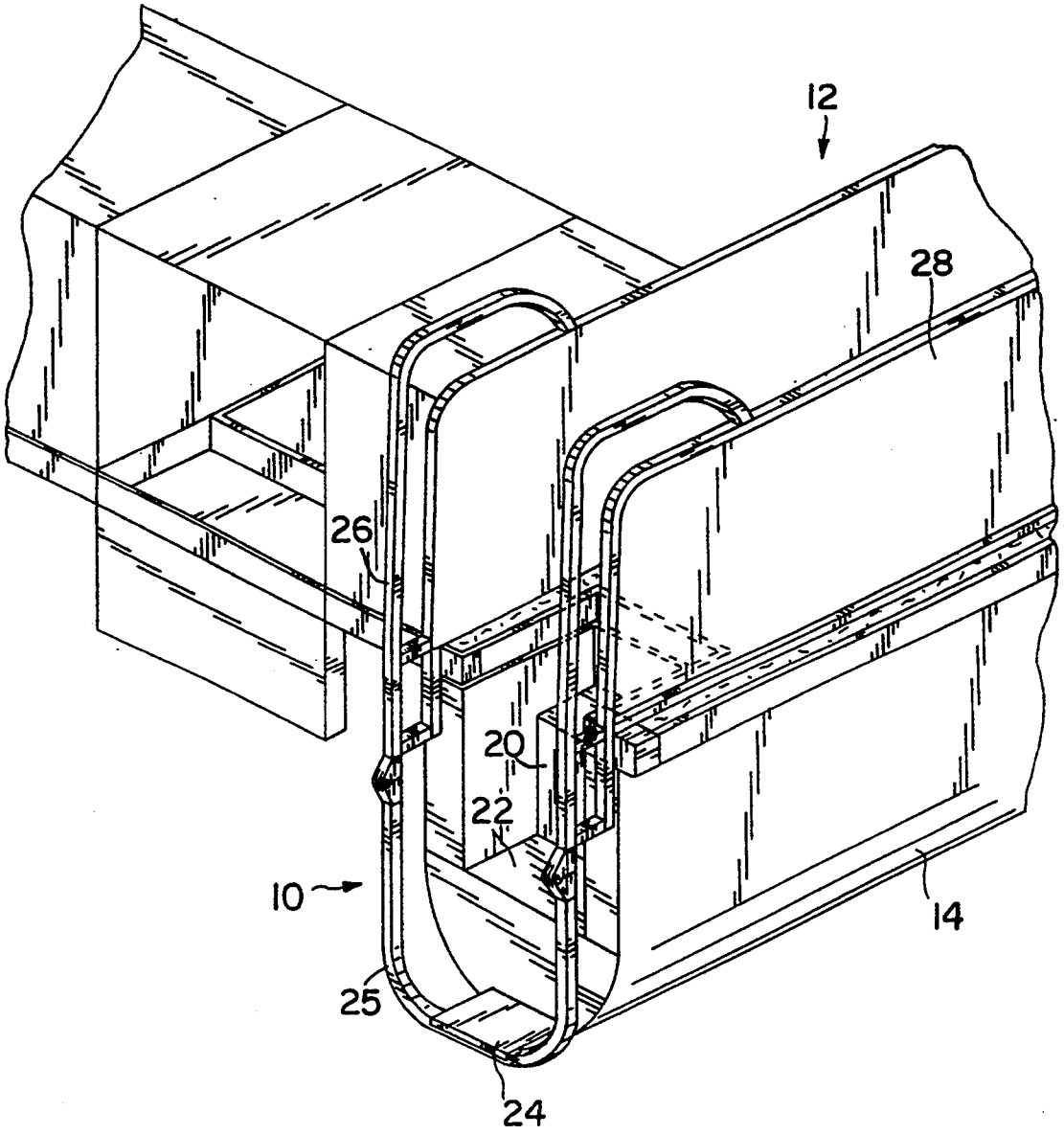
FIG. 2 is a perspective view, taken from the rear and the side of the boat, of the rear access step configuration formed into the rear of one of the cylindrical hulls.

The other advantage is that the trapezoid end 16 of hull 14 provides an area in which a recessed step configuration 10 can be formed. FIG. 1 shows one of the hulls 14 having a flat planar end face 18. The other hull end 16 is modified to form the rear access step configuration 10. This can be done by welding, cutting or molding as is understood by those having skill in the art of building this type of pontoon hull. Risers 20 and steps 22 are thus formed in to the back side and top wall of hull 14 as shown in FIGS. 2 through 4. Typically, a series of two steps and risers are formed, but it is to be understood that this number can be varied. The first step will be disposed at a height above the bottom surface of hull end 16.

An auxiliary step member 24 is provided at the bottom edge of end 16 as shown in FIG. 3. It can be mounted to hull end 16 by bolting or the like. Hand rails 26 are also mounted on hull end 16 and run along the outer edge of deck side wall 28. Step member 24 is best comprised of a U-shaped member 25 having ends hingedly connected to hand rails 26 and is pivotable so that it may be retracted up and away out of position as shown in FIG. 4 to prevent drag and water spray while the boat is in motion. The plane of hull end 16 is angled 5°–15° forward from the vertical plane, which gives the step configuration and hand rails a forward inclination for ease in climbing. Step member 24 approximates the shape of and is supported against the bottom of truncated end 16 due to the forward incline. Multiple ascending stepping surfaces may be provided on step member 24 for greater ease in climbing out of the water.

USE

The rear access step configuration of the instant invention enables a person in the water to very safely and easily mount a pontoon boat from the rear without the use of or need for extraneous ladder equipment or assistance from others. The pontoon hulls 14 lie partially submerged in the water, thus presenting hull end 16 having the step configuration 10 for easy access to a swimmer. The swimmer merely grasps the hand rails 26 and steps up on auxiliary step member 24 and climbs aboard. Considerably less exertion is required for walking up forwardly inclined steps directly on to the deck of the boat rather than climbing a vertically extending ladder and then having to swing one's leg over the deck side walls. The step configuration is always present and provides a safe and reliable means of getting out of the water that is often not possible with the more traditional ladders that have to be swung over the side by a person already on the boat. Side walls 28 are thus preserved and need not undergo the abuse caused by the extraneous ladders. More importantly, a person accidentally falling overboard can climb back aboard by himself using the step configuration; this would prevent the disastrous consequence which would follow if the person were alone and could not retrieve and attach a rescue ladder.

Various changes and modifications may be made within this invention as will be apparent to those skilled in the art. Such changes and modifications are within the scope and teaching of this invention as defined in the claims appended hereto.

What is claimed is:

1. In a pontoon boat comprising a platform mounted on a pair of hollow tubular hulls, the improvement comprising a rear access step configuration, said step configuration being formed in an end of one of said hulls, said step configuration being bounded at its sides by a wall of said hull, whereby access upon said boat by a person in the water can be gained from an end of said boat, an auxiliary step member for said step configuration being provided at and being supported against a lower portion of said hull end in which said step configuration is formed to assist a person in the water to climb upon said step configuration.

2. The pontoon boat of claim 1 in which said auxiliary step member is pivotable whereby it is retractable to a position out of the water to avoid drag and water spray when said boat is in motion.

3. The pontoon boat of claim 1 in which hand rails are provided at said hull end in which said step configuration is formed to assist a person in the water to climb upon said step configuration and into said boat.

4. The pontoon boat of claim 1 in which an auxiliary step member is provided at a lower portion of said hull end in which said step configuration is formed to assist a person in the water to climb upon said step configuration, said auxiliary step member being pivotable whereby it is retractable to a position out of the water to avoid drag and water spray when said boat is in motion, and hand rails are provided at said hull end in which said step configuration is formed to assist a person in the water to climb upon said step configuration and into said boat.

5. The pontoon boat of claim 4 in which said auxiliary step member is comprised of a U-shaped frame member having a transverse section and two end sections, said transverse section having a foot support element, and said end sections being hingedly connected to said hand rails.

6. In a pontoon boat comprising a platform mounted on a pair of hollow tubular hulls, the improvement comprising said pair of hollow tubular hulls each having a truncated end slanting forward at a stern end of said boat, one of said hulls having a step configuration formed in said truncated end, said step configuration being bounded at its sides by the wall of said hull, whereby access upon said boat by a person can be gained from an end of said boat while in the water.

7. The pontoon boat of claim 6 in which an auxiliary step member is provided at and is supported against a lower portion of said hull end having said step configuration to assist a person in the water to climb upon said step configuration.

8. The pontoon boat of claim 7 in which said auxiliary step member is pivotable whereby it is retractable to a position out of the water to avoid drag and water spray when said boat is in motion.

9. The pontoon boat of claim 6 in which hand rails are provided at said hull end having said step configuration to assist a person in the water to climb upon said step configuration and into said boat.

10. The pontoon boat of claim 6 in which an auxiliary step member is provided at a lower portion of said hull end having said step configuration to assist a person in the water to climb upon said step configuration, said auxiliary step member being pivotable whereby it is retractable to a position out of the water to avoid drag and water spray when said boat is in motion, and hand rails are provided at said hull end having said step configuration to assist a person in the water to climb upon said step configuration and into said boat.

11. The rear access step configuration of claim 10 in which said auxiliary step member is comprised of a U-shaped frame member having a transverse section and two end sections, said transverse section having a foot support element, and said end sections being hingedly connected to said hand rails, said U-shaped frame member being supported against a bottom portion of said truncated end.

12. In a pontoon boat, the improvement comprising a pair of hollow tubular hulls each having a truncated end slanting forward at a stern end of said boat, one of said hulls having a step configuration formed in said truncated end, whereby access upon said boat by a person can be gained from an end of said boat while in the water, each of said truncated ends of said hollow hulls lying in a plane 5°–15° forward from a vertical plane, said step configuration having risers lying in planes parallel to said truncated end.

13. The pontoon boat of claim 12 in which an auxiliary step member is provided at a lower portion of said hull end having said step configuration to assist a person in the water to climb upon said step configuration.

14. The pontoon boat of claim 13 in which said auxiliary step member is pivotable whereby it is retractable to a position out of the water to avoid drag and water spray when said boat is in motion.

15. The pontoon boat of claim 12 in which hand rails are provided at said hull end having said step configuration to assist a person in the water to climb upon said step configuration and into said boat.

16. The pontoon boat of claim 12 in which an auxiliary step member is provided at a lower portion of said hull end having said step configuration to assist a person in the water to climb upon said step configuration, said auxiliary step member being pivotable whereby it is retractable to a position out of the water to avoid drag and water spray when said boat is in motion, and hand rails are provided at said hull end having said step configuration to assist a person in the water to climb upon said step configuration and into said boat.

17. The rear access step configuration of claim 12 in which said auxiliary step member is comprised of a U-shaped frame member having a transverse section and two end sections, said transverse section having a foot support element, and said end sections being hingedly connected to said hand rails, said U-shaped frame member being supported against a bottom portion of said truncated end.

* * * * *